US005928065A

United States Patent [19]

Shih

[11] Patent Number: 5,928,065

[45] Date of Patent: Jul. 27, 1999

[54] CENTERLESS GRINDING MACHINE WITH OPTIMAL REGULATING WHEEL TRUING AND DRESSING

[75] Inventor: Albert J. Shih, Columbus, Ind.

[73] Assignee: Cummins Engine Company, Inc., Columbus, Ind.

[21] Appl. No.: 09/020,545

[22] Filed: Feb. 9, 1998

[51] Int. Cl.[6] ..... B24B 7/00

[52] U.S. Cl. ..... 451/72; 451/56; 451/243; 451/443

[58] Field of Search ..... 451/56, 72, 243, 451/443

[56] References Cited

U.S. PATENT DOCUMENTS

| | | | |
|---|---|---|---|
| 1,590,190 | 6/1926 | Heim . | |
| 1,860,614 | 5/1932 | Hohnhorst et al. . | |
| 2,855,729 | 10/1958 | Render . | |
| 3,079,741 | 3/1963 | Render | 451/49 |
| 3,534,502 | 10/1970 | Lovely . | |
| 4,004,568 | 1/1977 | Maxey . | |
| 4,570,386 | 2/1986 | Unno et al. . | |
| 5,551,908 | 9/1996 | Harada | 451/72 |
| 5,766,057 | 6/1998 | Maack | 451/21 |

*Primary Examiner*—David A. Scherbel
*Assistant Examiner*—Shantese McDonald
*Attorney, Agent, or Firm*—Sixbey, Friedman, Leedom & Ferguson; Charles M. Leedom, Jr.; Tim L. Brackett, Jr.

[57] ABSTRACT

An improved truing and dressing assembly and associated thru-feed centerless grinding machine is provided which effectively shapes the outer surface of a regulating wheel so as to allow the regulating wheel to follow the profile of the workpiece during grinding thereby avoiding interference between the regulating wheel and the workpiece outer surface thereby resulting in improved high precision grinding. The truing and dressing assembly of the present invention includes a truing wheel mounted on one side of the regulating wheel opposite the side on which the workpiece and workpiece support are mounted. The truing wheel is designed with an outer surface having a radius of curvature equal to the radius of curvature of the outer surface of the final ground workpiece. In addition, the truing wheel and workpiece are positioned at the same height above a reference plane extending through the rotational axis of the grinding wheel. This set-up arrangement permits the truing wheel to form an optimum regulating wheel profile which does not interfere with the outer surface of the workpiece during grinding thereby achieving optimum grinding operations while minimizing the cost and time required to set-up the machine.

11 Claims, 3 Drawing Sheets

Y
48
44
mm
40
36
32
-170
-166
-162
mm
-158
-154
X
WORKPIECE
MIDDLE CIRCLE
FRONT CIRCLE
REGULATING WHEEL
REAR CIRCLE

Y
48
44
mm
40
36
32
154
158
162
mm
166
170
X
TRUING WHEEL
MIDDLE CIRCLE
FRONT CIRCLE
REGULATING WHEEL
REAR CIRCLE

Y
104
200
202
R
204
H
208
X

CENTERLESS GRINDING MACHINE WITH OPTIMAL REGULATING WHEEL TRUING AND DRESSING

TECHNICAL FIELD

This invention generally relates to a centerless grinding machine including a regulating wheel and particularly to both a machine and method for truing and dressing a regulating wheel which improves the precision of the grinding operation.

BACKGROUND OF THE INVENTION

Thru-feed centerless grinding is a manufacturing process commonly used to generate a precise cylindrical geometry on a workpiece. Since thru-feed centerless grinding can generate the cylindrical form with tight tolerances while forming a fine surface finish, it has become very popular in the bearing, automotive and fuel system industries for the production of precision bearing races, shafts, plungers, etc. Thru-feed centerless grinding is especially widely used in fuel systems manufacturing to generate a sub-micron precision, cylindrical shape match diameter, for example, on a fuel injector plunger or needle valve element.

A thru-feed centerless grinding machine includes three primary components: a grinding wheel, a work-rest blade and a regulating wheel. Grinding of a workpiece takes place between the rotating regulating wheel and the rotating grinding wheel. The work-rest blade is used to support the workpiece at a given center-height. The regulating wheel, usually formed of a rubber-like material having a high coefficient of friction, moves the workpiece axially through the machine while rotating the workpiece at a constant speed to during grinding. The regulating wheel is tilted at a small angle to generate a force component in the axial direction to push the workpiece through the gap between the regulating and grinding wheels.

The precision tolerance requirements for diesel fuel system components have steadily been tightened in recent years to improve the performance and durability of diesel fuel system components. Truing the regulating wheel to the proper form has been identified by the practical grinding engineers and researchers as the most critical step in the set-up of the precision thru-feed centerless grinding process. In the grinding arts, a "truing" operation is performed on a regulating wheel in order to insure that the profile of its peripheral surface is cut to a proper shape. By contrast, a "dressing" operation creates the desired frictional condition on the surface of the regulating wheel. Truing and dressing operations are often performed on both newly manufactured and used regulating wheels to initiate and maintain a desired profile and proper surface conditions on the wheel. The truing operation properly shapes the wheel by grinding away a portion of the peripheral surface of the wheel in accordance with a pattern. In many conventional thru-feed centerless grinding machines, the regulating wheel is trued and dressed by a single-point diamond tool. The single point diamond is traversed along a straight line at an angle relative to the regulating wheel axis of rotation. However, the workpiece will experience a change in the size of the gap between the grinding and regulating wheels as the workpiece moves along the gap due to the tilted position of the regulating wheel. This change in the size of the gap results in interference between the outer surface of the workpiece and the outer surface of the regulating wheel. This interference is a major source of error in conventional sub-micron precision thru-feed centerless grinding.

Moreover, accurate and time consuming set-up of the grinding machine is required to achieve sub-micron precision results. It is common for a manufacturing engineer to spend months, sometimes years, of trial-and-error experiments to set-up the machine and develop a capable sub-micron precision grinding process. Due to the difficulty, time and expense involved in the set-up process, the set-up in a production centerless grinder rarely changes once the process is set. This strategy greatly hinders the flexibility in the use of the grinding machine and consequently increases capital expenditures in the precision grinding operations.

U.S. Pat. No. 4,004,568 to Maxey discloses a method and apparatus for dressing regulating wheels in a centerless grinding machine that includes a cylindrical dressing wheel positioned to peripherally engage the regulating wheel. However, the dressing wheel is positioned on the same side of the regulating wheel as a workpiece would be positioned for grinding. Moreover, this reference does not discuss the significance of the diameter of the dressing wheel. Therefore, this grinding machine inherently produces undesirable interference between the outer surface of the workpiece and the outer surface of the regulating wheel thereby making sub-micron precision grinding practically impossible.

U.S. Pat. No. 3,534,502 to Lovely discloses a grinding wheel apparatus including a dressing tool wherein a workpiece diameter and the dressing tool diameter are identical and are equidistant from the grinding wheel center. The dressing tool, however, is used to dress the grinding wheel, not a regulating wheel. In fact, this grinding device is not a thru-feed centerless machine and therefore does not suggest using a regulating wheel.

U.S. Pat. No. 1,860,614 to Hohnhorst et al. discloses a mechanism for truing and dressing an auxiliary grinding wheel of a centerless grinder including an abrading wheel. However, the abrading wheel is positioned at a different height, relative to the center of the auxiliary grinding wheel, than the workpiece. Moreover, the abrading wheel may have a diameter different than the finished workpiece. Thus, this grinding machine inherently produces undesirable interference between the outer surface of the workpiece and the outer surface of the regulating wheel thereby making sub-micron precision grinding practically impossible.

U.S. Pat. No. 4,570,386 to Unno et al. discloses a regulating wheel dressing system for achieving precision grinding by dressing the regulating wheel using a single point truing and dressing tool and varying the position of the single point truing and dressing tool in the X direction. However, the movement path of the single point truing and dressing tool is determined mathematically and therefore it is difficult to determine the exact line for a given set of conditions. More importantly, it is practically impossible to control the movement of the single point truing and dressing tool so as to ensure the tool moves along the mathematically defined path. In addition, the mathematically defined path changes as the size of the regulating wheel changes, for instance, after each truing operation. As a result, no practical embodiment of this type of truing and dressing assembly has been produced which is capable of achieving sub-micron precision grinding.

Consequently, there is a need for a thru-feed centerless grinding machine having a truing and dressing system capable of optimally truing and dressing a regulating wheel to ensure sub-micron precision grinding.

SUMMARY OF THE INVENTION

In view of the foregoing, it is an object of the present invention to provide a thru-feed centerless grinding machine capable of achieving sub-micro precision grinding.

Another object of the present invention is to provide a thru-feed centerless grinding machine which is minimizes the cost and time necessary to set-up the machine.

A further object of the present invention is to provide a thru-feed centerless grinding machine capable of meeting extremely tight tolerance requirements while maximizing the flexibility of the machine being easily set-up for a variety of different applications.

Yet another object of the present invention is to provide a thru-feed centerless grinding machine including a regulating wheel capable of very precisely guiding a workpiece in a straight path through the machine.

Still another object of the present invention is to provide a thru-feed centerless grinding machine including a regulating wheel and a rotary truing wheel for effectively truing the outer surface of the regulating wheel to ensure precision grinding.

It is a still further object of the present invention is to provide a thru-feed centerless grinding machine including a regulating wheel and a rotary truing wheel which minimizes interference between the regulating wheel and the workpiece.

These and other objects of the present invention are achieved by providing a centerless grinding machine for grinding a workpiece, having a rotational centerpoint, to a precise dimension, comprising a rotatable grinding wheel mounted for rotation about a rotational axis and positioned for grinding the workpiece, a regulating wheel, a workpiece support means and a truing wheel operable to prevent interference between the regulating wheel and the workpiece. The regulating wheel is mounted for rotation about a regulating wheel rotational axis and positioned a spaced distance from the grinding wheel to form a channel between the grinding wheel and the regulating wheel for receiving the workpiece. The regulating wheel includes an outer surface forming a first side facing the regulating wheel and a second side. The workpiece support supports the workpiece during movement through the channel. The truing wheel is mounted for rotation about a truing rotational centerpoint and positioned adjacent the second side of the regulating wheel for contacting and shaping the outer surface of the regulating wheel. The rotational centerpoint of the workpiece and the truing rotational centerpoint are positioned an equal distance from a reference plane extending through and positioned along the rotational axis of the regulating wheel so as to prevent interference between the regulating wheel and the workpiece.

The precise dimension of the workpiece may be a workpiece diameter wherein the outer surface of the truing wheel defines a truing wheel diameter equal to the workpiece diameter. Stated in different terms, the truing wheel may include an outer surface having a truing wheel radius of curvature wherein the truing wheel radius of curvature and a workpiece radius of curvature are equal. Preferably, the rotational axis of the regulating wheel extends at an angle relative to the grinding wheel rotational axis to create a driving force for the workpiece.

The present invention is also directed to a method of truing and dressing a regulating wheel of a centerless grinding machine for grinding a workpiece, having a rotational centerpoint, to a precise workpiece radius of curvature, comprising the steps of positioning a first side of the regulating wheel adjacent a workpiece holder for supporting the workpiece, providing a rotatable truing wheel including a truing rotational centerpoint and an outer surface having a truing wheel radius of curvature equal to the workpiece radius of curvature, positioning the rotatable truing wheel adjacent a second side of the regulating wheel opposite the first side, adjusting the position of at least one of the workpiece holder and the rotatable truing wheel to position the truing rotational centerpoint and the workpiece rotational centerpoint an equal distance from a reference plane extending through and positioned along a rotational axis of the regulating wheel, and moving the truing wheel axially along the regulating wheel while rotating both the truing wheel and the regulating wheel. The method also may include the step of providing a grinding wheel including a grinding wheel rotational axis and positioning the regulating wheel so that the rotational axis of the regulating wheel extends at an angle relative to the grinding wheel. In another embodiment, the regulating wheel may rotate in a rotational plane substantially perpendicular to the rotational plane of the regulating wheel.

DETAILED DESCRIPTION OF THE PRESENT INVENTION

Figure 1A:
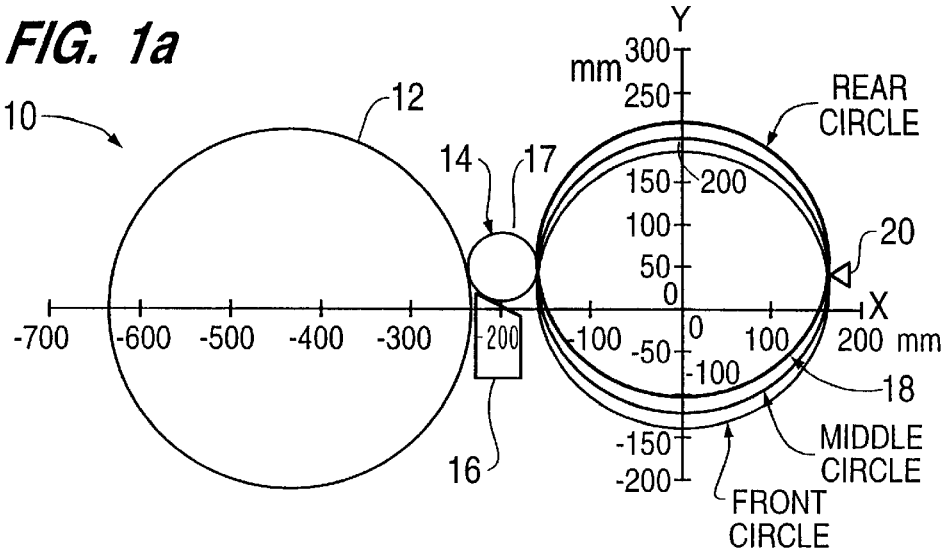
FIG. 1*a* is a schematic front view of a conventional thru-feed centerless grinding machine.
Figure 1B:
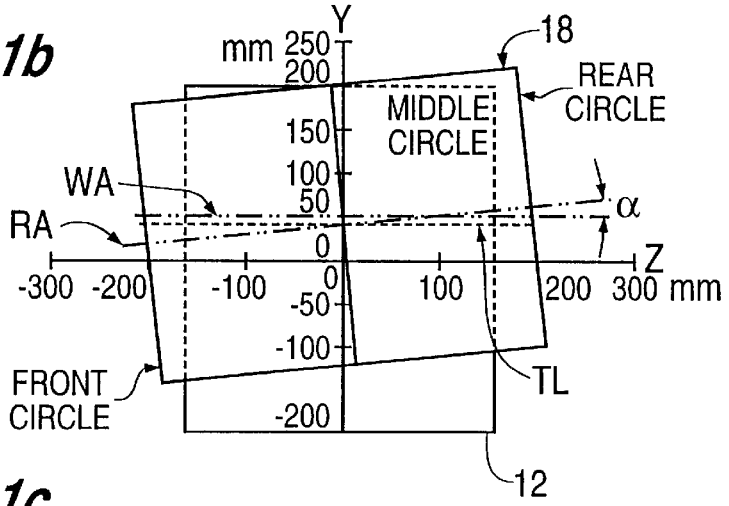
FIG. 1*b* is a schematic side view of the conventional grinding machine of FIG. 1*a;*
Figure 1C:
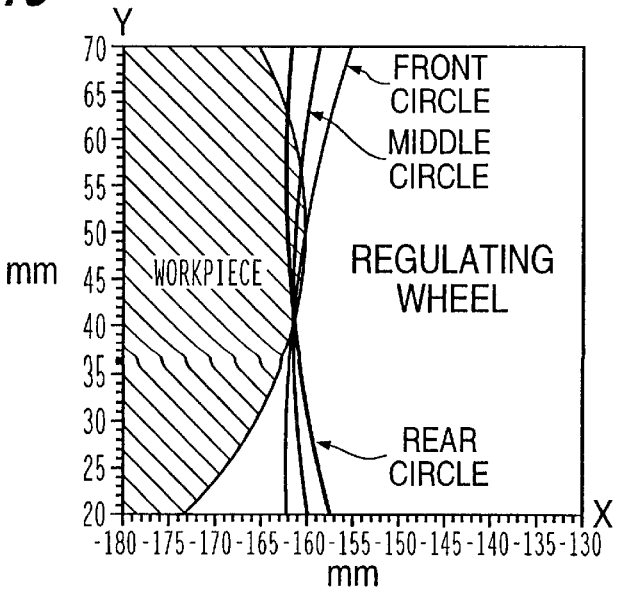
FIG. 1*c* is an exploded front view of the workpiece and regulating wheel interface in the conventional thru-feed centerless grinding machine of FIG. 1*a* showing the interference between the workpiece and regulating wheel along the length of the regulating wheel.

FIGS. 1*a*, 1*b* and 1*c* are provided to clearly show the advantages of the centerless grinding machine of the present invention over a conventional thru-feed centerless grinding machine. As shown in FIG. 1*a*, a conventional thru-feed centerless grinding machine 10 includes a grinding wheel 12 rotatably mounted on a support frame (not shown) for grinding a workpiece 14 supported by a workpiece support or blade 16 mounted adjacent grinding wheel 12. Grinding machine 10 also includes a regulating wheel 18 mounted a spaced distance from the grinding wheel 12 on the opposite side of workpiece support 16 to form a gap or channel 17 for receiving workpiece 14. Regulating wheel 18 functions to move the workpiece axially through the machine while rotating the workpiece at a constant speed during grinding. Regulating wheel 18 is tilted so that its rotational axis RA is positioned at a small angle $\alpha$ relative to the axis WA of the workpiece (FIG. 1*b*) to generate a force component in the axial direction to push the workpiece through the channel 17 between the regulating and grinding wheels in a conventional manner. A single point truing and dressing tool 20 is positioned on a side of the regulating wheel 18 opposite workpiece 14 for cutting or forming the outer surface of regulating wheel 18 to a proper shape critical to the precision grinding of workpiece 14. FIGS. 1*a* and 1*b* clearly show a XYZ Cartesian coordinate system wherein the X axis, which is perpendicular to the YZ plane, passes through the center of the grinding wheel rotational axis, the Z axis is parallel to the axes of the grinding wheel and workpiece, and the Y axis is perpendicular to both the X and Z axes. The single point diamond truing and dressing tool 20 is traversed along a straight line, i.e. truing line TL, parallel to a plane formed by the X and Z axes (XZ plane) between grinding events so as to true the outer surface of the regulating wheel 18 while dressing the outer surface to create the desired frictional condition.

Although the conventional thru-feed centerless grinding machine shown in FIGS. 1*a* and 1*b* functions adequately in certain applications, the single point truing and dressing tool 20 necessarily prevents this type of machine from producing a workpiece having a diameter within the sub-micron precision tolerance requirements required in many other applications. It has been found that the use of the single point truing and dressing tool 20 creates a regulating wheel having a profile which necessarily results in slight but significant interference between regulating wheel 18 and workpiece 14 during grinding thereby making precision sub-micron grinding practically difficult. Referring to FIGS. 1*a* and 1*b*, since regulating wheel 18 is positioned at an angle α regulating wheel 18 can be viewed as forming three circles: a front circle positioned in the plane of the front portion of the regulating wheel; a middle circle positioned in a plane extending transversely through the middle of regulating wheel 18; and a rear circle positioned in a plane extending transversely through the rear portion of the regulating wheel 18. During movement of single point truing and dressing tool 20 along regulating wheel 18, tool 20 cuts regulating wheel 18 to form a profile which takes on the shape of a hyperboloid of one sheet. This hyperbolic regulating wheel shape undesirably interferes with the grinding of workpiece 14 so as to actually cause more material to be ground off, or removed from, the outer surface of workpiece 14 than desired. As shown in FIG. 1*c*, as the workpiece is fed through grinding machine 10, the front circle interferes a minimal amount whereas the middle and then rear circles of the regulating wheel 18 interfere with the position of the workpiece 14 to a greater amount, respectively. As a result, the regulating wheel undesirably moves the workpiece 14 against grinding wheel 12 with a greater force thereby disadvantageously causing greater than the desired amount of grinding and a workpiece having geometrical forms perhaps outside the predetermined tolerance requirements. Each time the regulating wheel 18 is trued and dressed by single point truing and dressing tool 20, the degree of interference between regulating wheel and workpiece 14 changes thereby making compensation for the interference practically impossible.

Figure 2:
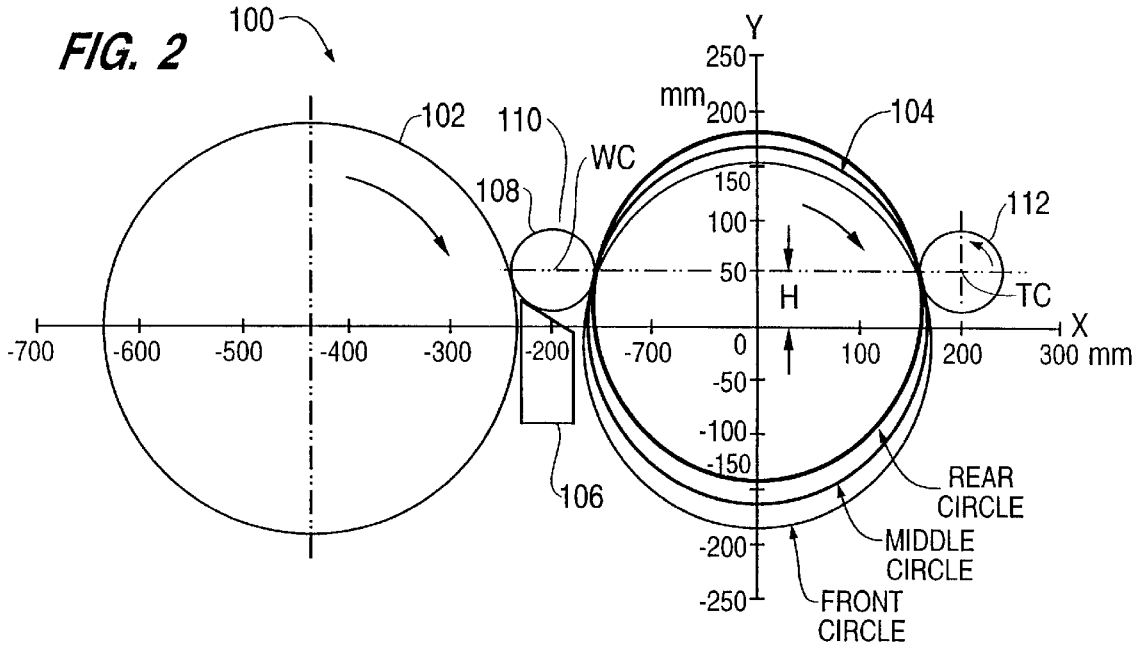
FIG. 2 is a schematic front view of the thru-feed centerless grinding machine of the present invention.
Figure 3:
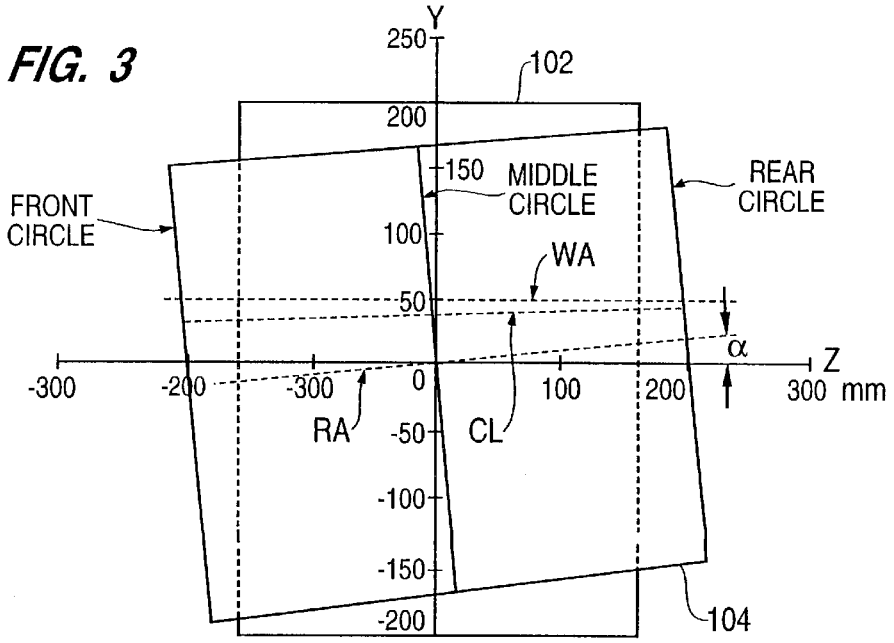
FIG. 3 is a schematic side view of the present thru-feed centerless grinding machine of FIG. 2.

Referring now to FIGS. 2, 3, 4*a* and 4*b*, the thru-feed centerless grinding machine of the present invention, indicated generally at 100, is similar to the conventional grinding machine of FIG. 1*a* in that thru-feed centerless grinding machine 100 includes a rotatably mounted grinding wheel 102, a rotatably mounted regulating wheel 104 positioned a spaced distance from grinding wheel 102 and a workpiece support or blade 106 positioned between grinding wheel 102 and regulating wheel 104. A workpiece 108 is fed into a channel 110 formed between grinding wheel 102 and regulating wheel 104 while being supported by workpiece blade 106. Regulating wheel 104 is formed from a material having a high coefficient friction thereby holding the workpiece in channel 110 while rotating the workpiece during grinding. As shown in FIG. 3, regulating wheel 104 is positioned so that its rotational axis RA is positioned at an angle α relative to the Z axis. As before, the Cartesian coordinate system in the drawings includes a X axis, perpendicular to the YZ plane, which passes through the center of the rotational axis of grinding wheel 102. The Y axis is perpendicular to both the X and Z axes. The angle α at which regulating wheel 104 is positioned causes the workpiece to move axially through the machine during grinding.

Importantly, the thru-feed centerless grinding machine 100 of the present invention operates to effectively prevent undesirable interference between the regulating wheel 104 and workpiece 108, unlike the conventional grinding machine of FIG. 1*a*. The thru-feed centerless grinding machine 100 of the present invention achieves this result by using a truing wheel 112 which is sized and positioned to true or shape the outer surface of regulating wheel 104 so as to create an optimum regulating wheel profile or shape which avoids interference with workpiece 108 during grinding thereby permitting sub-micron precision results. Specifically, truing wheel 112 achieves optimum truing of regulating wheel 104 through the use of three basic set-up principles. First, truing wheel 110 is formed with an outer surface having a radius of curvature equal to the radius of curvature of the workpiece after final grinding. In other words, truing wheel 112 is designed with the same diameter as the diameter of the workpiece after the grinding of the workpiece is complete. Since the diameter of the workpiece 108 is known prior to grinding operations, truing wheel 112 can easily be formed with the same diameter as the final ground workpiece diameter. Secondly, truing wheel 112 trues or contacts regulating wheel 104 at the same distance from a reference plane XZ extending through the rotational axis of grinding wheel 102 as the distance between reference plane XZ and the contact point between workpiece 108 and regulating wheel 104. In other words, truing wheel 112 trues the regulating wheel 104 at the same height, i.e. predetermined distance H, as the workpiece. This second set-up condition can be met simply by positioning the truing wheel rotational centerpoint TC at the same predetermined distance H above reference plane XZ as a workpiece rotational centerpoint WC. Third, truing wheel 112 is positioned on the opposite side of regulating wheel 104 from workpiece 108. By meeting these three conditions, the present truing and dressing apparatus forms an optimum regulating wheel shape or profile which does not interfere with the outer surface of workpiece 108 during grinding thereby permitting precision grinding within sub-micron tolerance requirements. It should be noted that truing wheel 112 could be designed to rotate in the same or the opposite direction as regulating wheel 104.

Figure 4A:
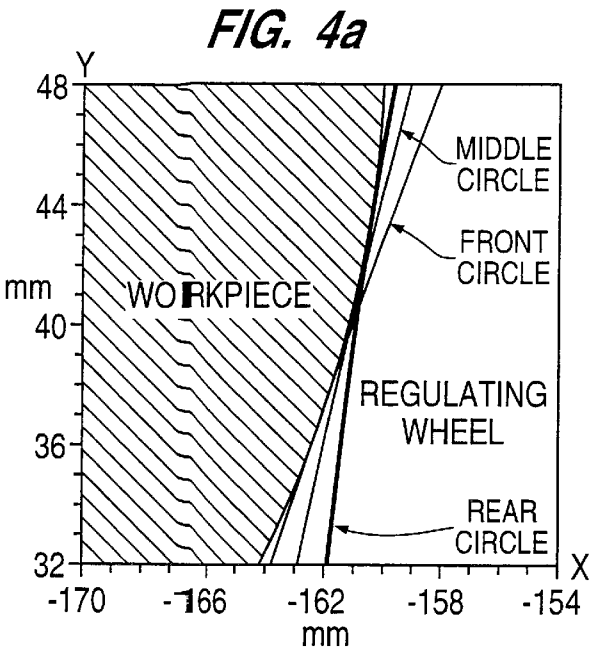
FIG. 4*a* is an exploded partial front view of the interface between the workpiece and regulating wheel of the present machine of FIG. 2.
Figure 4B:
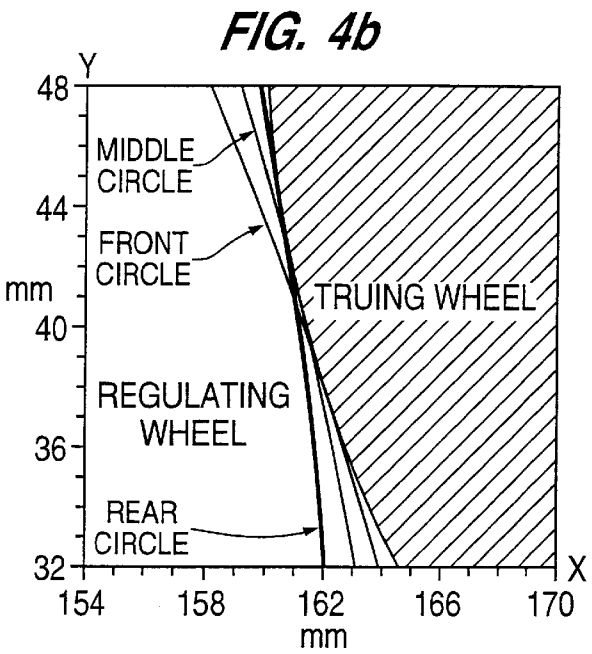
FIG. 4*b* is an exploded partial front view of the interface between the regulating wheel and the truing wheel of the present machine of FIG. 2.

Truing wheel 112 prevents interference between regulating wheel 104 and workpiece 108 by moving in a tangential manner along the outer surface of regulating wheel 104 during movement along the length of regulating wheel 104. Thus, as shown in FIG. 4*b*, as truing wheel 112 moves along the length of regulating wheel 104 from the front circle to the rear circle, the outer surfaces of the respective wheels remain in tangential contact. It can be seen in FIG. 4*b* that the point of contact between truing wheel 112 and regulating wheel 104 moves along the outer surface of truing wheel 112 increasing the distance between the point of contact and reference plane XZ as truing wheel 112 moves from the front circle to the rear circle. It has been found that the resulting shape or profile of regulating wheel 104, in turn, properly cooperates with the outer surface of workpiece 108 so as to avoid interference with workpiece 108. Specifically, as shown in FIG. 4*a*, the contact point between regulating wheel 104 and workpiece 108 moves upwardly in the figure as the workpiece moves toward the rear circle of regulating wheel 104 while remaining tangential to the final desired workpiece surface. Thus, the outer surface of regulating wheel 104 follows the profile of the workpiece as the workpiece 108 moves through channel 110. As shown in FIG. 3, the contact line CL between workpiece 108 and regulating wheel 104 extends at a small angle upwardly relative to the Z axis which corresponds to the point of contact moving upwardly as shown in FIG. 4*a*. As a result, interference between regulating wheel 104 and workpiece 108 is avoided.

Figure 5:
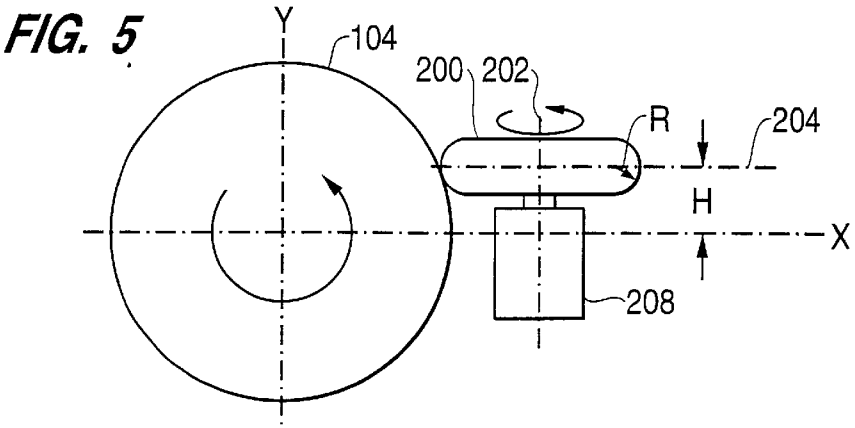
FIG. 5 is a schematic front view of a second embodiment of the present truing and dressing portion of the present grinding machine.

Referring now to FIG. 5, a second embodiment of the present thru-feed centerless grinding machine is similar to the embodiment of FIG. 2 except that a different truing wheel assembly is used. Specifically, a truing wheel 200 is positioned adjacent regulating wheel 104 so as to rotate about a truing wheel rotational axis 202 extending in the same direction as the Y axis and rotating in a truing plane 204 substantially perpendicular to a regulating wheel rotational plane 206 in which the regulating wheel 104 rotates. Truing wheel 200 is mounted on a shaft of a truing spindle 208 so that truing plane 204 is positioned the same predetermined height, i.e. distance H, from a reference plane extending through the grinding wheel rotational axis, as the height of the workpiece. The rotation of truing wheel 200 is accomplished in a conventional manner by, for instance, a motor assembly (not shown). Importantly, the outer annular surface of truing wheel 200 is formed with a radius of curvature R equal to the radius of curvature of the final ground workpiece positioned on the opposite side of regulating wheel 104. Thus, all the advantages discussed hereinabove with respect to the previous embodiment are achieved by forming the outer annular surface with the radius of curvature R, regardless of the diameter of the entire truing wheel 200. Therefore, the embodiment of FIG. 5 also avoids interference between truing wheel 200 and regulating wheel 104 thereby avoiding interference between regulating wheel 104 and the workpiece. As a result, this embodiment also creates an optimum regulating wheel profile which accurately follows the profile of the workpiece during grinding without undesirable variations in the contour of the regulating wheel profile and thus avoiding an excessive amount of grinding due to such variations.

Prior to truing and dressing the regulating wheel 104, the truing wheel 112, 200 is chosen so that the radius of curvature or diameter of truing wheel 112, or the radius of curvature R of truing wheel 200, is equal to the final ground diameter of the workpiece. The truing wheel 112, 200 is then mounted on the side of regulating wheel 104 opposite workpiece support blade 106 and grinding wheel 102. Importantly, truing wheel 112, 200 is positioned at the same height or distance H as the workpiece 108, above the reference plane XZ extending through the rotational axis of grinding wheel 102. Thus, truing wheel 112 is positioned so that truing wheel rotational centerpoint TC is positioned at the same distance H as workpiece 108. Similarly, truing wheel 200 is positioned so that the truing plane 204 is positioned a distance H equal to the distance the workpiece rotational centerpoint WC is spaced from reference plane XZ. In the conventional manner, truing wheel 112, 200 is then traversed along the length of regulating wheel 104 in the Z direction so as to true and dress the outer surface of regulating wheel 104.

The present invention results in distinct advantages over conventional truing and dressing assemblies for centerless grinding machines. First, the present truing and dressing assembly effectively creates an optimum regulating wheel shape or profile which very precisely follows the profile of the workpiece during grinding thereby permitting sub-micron precision grinding. Conventional truing and dressing tools typically use a single point tool which undesirably creates a hyperboloid shaped regulating wheel profile which interferes with, and does not follow the profile of, the workpiece thereby resulting in excessive grinding as the workpiece moves through the machine. As a result, these conventional single point dressing assemblies do not permit the associated grinding machine to produce products within sub-micron tolerance requirements without spending months, or even years, of trial-and-error experiments to find the precise machine set-up. Other designers have suggested that the hyperboloid problem may be overcome by varying the position of a single point truing and dressing tool in the X direction. However, the movement path of the single point truing and dressing tool is determined mathematically and therefore it is difficult to determine the exact line for a given set of conditions. More importantly, it is practically impossible to control the movement of the single point truing and dressing tool so as to ensure the tool moves along the mathematically defined path. In addition, the mathematically defined path changes as the size of the regulating wheel changes, for instance, after each truing operation. As a result, no practical embodiment of this type of truing and dressing assembly has produced which is capable of achieving sub-micron precision grinding. Secondly, the thru-feed centerless grinding machine including the truing and dressing assembly of the present invention greatly decreases the set-up time for a given application thereby reducing costs and increasing manufacturing performance. Also, the present invention greatly increases the flexibility of using the present thru-feed centerless grinding machine in a variety of applications without dedicating a particular machine to a given application as previously required thereby decreasing capital expenditures in manufacturing operations.

INDUSTRIAL APPLICABILITY

The dressing and truing assembly of the present invention may be used in any thru-feed centerless grinding machine including a regulating wheel needing truing and dressing. The present truing and dressing assembly and method, and the associated thru-feed centerless grinding machine, is especially advantageous for grinding applications wherein the final ground workpiece dimension must fall within sub-micron tolerance requirements.

I claim:

1. A centerless grinding machine for grinding a workpiece, having a rotational centerpoint, to a precise dimension, comprising:

a grinding wheel mounted for rotation about a rotational axis and positioned for grinding the workpiece;

a rotatable regulating wheel positioned a spaced distance from said grinding wheel to form a channel between said grinding wheel and said regulating wheel for receiving the workpiece, said regulating wheel including an outer surface forming a first side facing said grinding wheel and a second side;

a workpiece support means for supporting the workpiece during movement through said channel;

a truing wheel mounted for rotation about a truing rotational centerpoint and positioned adjacent said second side of said regulating wheel for contacting and shaping said outer surface of said regulating wheel, wherein the rotational centerpoint of the workpiece and said truing rotational centerpoint are positioned an equal distance from a reference plane extending through and positioned along said rotational axis so as to prevent interference between said regulating wheel and the workpiece.

2. The machine of claim 1, wherein the precise dimension of the workpiece is a workpiece diameter, said outer surface of said truing wheel defining a truing wheel diameter equal to the workpiece diameter.

3. The machine of claim 2, wherein said regulating wheel includes a regulating wheel rotational axis, said regulated wheel positioned so as to position said rotational axis of said regulating wheel at an angle relative to said grinding wheel rotational axis.

4. The machine of claim 1, wherein said regulating wheel rotates in a rotational plane, said truing wheel rotating in a truing plane substantially perpendicular to said regulating wheel rotational plane.

5. A centerless grinding machine for grinding a workpiece, having a center axis, to a precise workpiece radius of curvature, comprising:

a grinding wheel mounted for rotation about a rotational axis and positioned for grinding the workpiece;

a regulating wheel positioned a spaced distance from said grinding wheel to form a channel between said grinding wheel and said regulating wheel for receiving the workpiece, said regulating wheel including an outer surface forming a first side facing said grinding wheel and a second side;

a workpiece support means for supporting the workpiece during movement through said channel;

a truing wheel positioned adjacent said second side of said regulating wheel for contacting and shaping said outer surface of said regulating wheel, said truing wheel including an outer surface having a truing wheel radius of curvature, said truing wheel radius of curvature and the workpiece radius of curvature being equal.

6. The machine of claim 5, wherein said truing wheel is mounted for rotation about a truing wheel axis, the center axis of the workpiece and said truing wheel axis being positioned an equal distance from a reference plane extending through and positioned along said rotational axis of said regulating wheel.

7. The machine of claim 6, wherein said regulating wheel is mounted for rotation about a regulating wheel axis, said regulating wheel axis extending at an angle relative to said grinding wheel rotational axis.

8. The machine of claim 5, wherein said regulating wheel rotates in a rotational plane, said truing wheel rotating in a truing plane substantially perpendicular to said regulating wheel rotational plane.

9. A method of truing and dressing a regulating wheel of a centerless grinding machine for grinding a workpiece, having a rotational centerpoint, to a precise workpiece radius of curvature, comprising the steps of:

providing a grinding wheel mounted for rotation about a grinding wheel rotational axis, positioning a first side of the regulating wheel adjacent a workpiece holder for supporting the workpiece, the regulating wheel mounted for rotation about a rotational axis;

providing a rotatable truing wheel including a truing rotational centerpoint and an outer surface having a truing wheel radius of curvature equal to the workpiece radius of curvature;

positioning said rotatable truing wheel adjacent a second side of the regulating wheel opposite said first side;

adjusting the position of at least one of said workpiece holder and said rotatable truing wheel to position said truing rotational centerpoint and the workpiece rotational centerpoint an equal distance from a reference plane extending through and positioned along said grinding wheel rotational axis; and moving said truing wheel axially along the regulating wheel while rotating both said truing wheel and the regulating wheel.

10. The method of claim 9, wherein a rotational axis of said regulating wheel extend at an angle relative to said grinding wheel rotational axis.

11. The machine of claim 9, wherein said regulating wheel rotates in a rotational plane, said truing wheel rotating in a truing plane substantially perpendicular to said regulating wheel rotational plane.

* * * * *